US006122226A

United States Patent [19]

Murakami et al.

[11] Patent Number: 6,122,226

[45] Date of Patent: Sep. 19, 2000

[54] COMBINATION ELECTRONIC WATCH

[75] Inventors: Eiki Murakami; Teruhiko Fujii; Tadashi Hasegawa, all of Tanashi, Japan

[73] Assignee: Citizen Watch Co., Ltd., Tokyo, Japan

[21] Appl. No.: 09/066,374

[22] PCT Filed: Sep. 4, 1997

[86] PCT No.: PCT/JP97/03110

§ 371 Date: Apr. 30, 1998

§ 102(e) Date: Apr. 30, 1998

[87] PCT Pub. No.: WO98/10336

PCT Pub. Date: Mar. 12, 1998

[30] Foreign Application Priority Data

Sep. 5, 1996 [JP] Japan ..... 8-234954
Sep. 10, 1996 [JP] Japan ..... 8-238728

[51] Int. Cl.[7] ..... G04B 19/04; G04B 1/00; G04C 19/00; G04C 3/00

[52] U.S. Cl. ..... 368/80; 368/82; 368/205

[58] Field of Search ..... 368/64, 66, 71, 368/80, 82, 203–205, 223

[56] References Cited

U.S. PATENT DOCUMENTS

| | | | |
|---|---|---|---|
| 3,786,624 | 1/1974 | Uchiyama | 368/205 |
| 4,785,436 | 11/1988 | Sase | 368/205 |
| 5,691,962 | 11/1997 | Schwartz et al. | 368/71 |

FOREIGN PATENT DOCUMENTS

| | | |
|---|---|---|
| 54-90278 | 12/1977 | Japan . |
| 56-58485 | 10/1979 | Japan . |
| 61-181394 | 11/1986 | Japan . |
| 62-89163 | 6/1987 | Japan . |
| 63-20093 | 2/1988 | Japan . |
| 6-43758 | 11/1994 | Japan . |

*Primary Examiner*—Vit Miska
*Attorney, Agent, or Firm*—Kaensaka & Takeuchi

[57] ABSTRACT

A combination electronic watch equipped with an optic power generating unit is provided, wherein a solar member and a liquid crystal member 4*c* are overlapped one onto the other and windows 4*c* are formed on the solar member so that a digital display will become possible at any location on the watch display surface and warnings for charging will be simultaneously provided by both the analog display of hands and the digital display.

7 Claims, 7 Drawing Sheets

COMBINATION ELECTRONIC WATCH

TECHNICAL FIELD

The present invention generally relates to a combination electronic watch into which an analog watch and a digital watch are integrally combined. More particularly, the invention relates to a combination electronic watch equipped with a solar power generation unit wherein a solar member and a digital display unit are positioned as being overlapped and a warning for charging can be simultaneously provided both by an analog display and by a digital display.

BACKGROUND ART

Combination watches, wherein an analog watch and digital watch have been integrally combined into one single unit, have come into wide use recently. Such combination watches that are equipped with solar power generation function have also been commercialized as well as ones having various functions added onto.

By referring to FIG. 5 and FIG. 6, an example of the prior art combination watches equipped with a solar power generation unit will be described.

FIG. 5 shows a cross sectional construction (along line 5—5 in FIG. 6) of a prior art combination watch equipped with a solar power generation unit, whereas FIG. 6 shows a plan view of the same watch with the dial removed.

The watch module of this combination electronic watch comprises analog block 1 which constitutes an analog watch as shown in FIG. 5, digital block 2 which is equipped with a liquid crystal member for opto-electronically display time and other information, support 3 for containing and holding said analog block 1 and digital block 2, solar member 4 for generating power, and solar member supporting frame 5 for containing and holding this solar member 4. Dial 6 is positioned on the display side of solar member. Analog block 1 is constituted on main plate 7 as a supporting base.

The combination electronic watch is, as shown in FIG. 6, constructed in such a manner that rotating axes 8 of hour hand 9*a*, minute hand 9*b*, and second hand 9*c* are located slightly toward the side of twelve o'clock from the center, and power generating surface 4*a* of solar member 4 occupies almost all the display surface of the watch except the digital display unit. Solar member 4 also has an opening 4*b* which rotating axis 8 of hands 9 passes through. Further, digital block 2, which is positioned approximately in the direction of six o'clock as horizontally seen, is positioned so as not to overlap said solar member 4 as shown in FIG. 5 and FIG. 6.

In addition, when the charge stored in a storage battery decreases to below a predetermined level due to the lack of light, such a combination electronic watch functions to display a warning for charging before it ceases to work as a watch. An analog warning for charging is, as shown in FIG. 6, provided by two second movement, which means that second hand 9*c* is moved once every two seconds. Whereas, a digital warning for charging is, as shown in FIG. 7, provided by blinking warning mark for charging 10 deposited on a part of digital block 2 for digitally displaying time.

However, the above mentioned combination watch may be improved in the following points.

First, since solar member 4 and digital block 2 are not deposited as being overlapped in the vertical direction toward the dial of the watch, it is impossible for digital block 2 which digitally displays time to be located within the region of power generating surface 4*a* of solar member 4. Accordingly, the design of the watch is significantly restricted. Although free and various designs are desired in combination watches, it is difficult to design new watches without altering its shape. Thus, in order to design a new watch, the shapes and locations of constituting components such as solar member 4 and digital block 2 must be changed, which causes a significant increase in manufacturing cost. This is why it is difficult to serialize attractive watches while employing the components constituting the above combination watch.

Secondly, since solar member 4 and digital block 2 are not deposited as being overlapped in the above construction, dead space "D", which is not used as a watch display from the design standpoint, necessarily comes to appear as shown in FIG. 6, thereby worsen the space efficiency. It would be preferable if this dead space "D" could be used as power generating surface 4*a* of solar member 4 so as to improve the capacity of solar power generation.

Thirdly, even though a user recognizes that second hand 9*c* moves once every two seconds, the user who does not know what is meant by this two second movement may not notice the currently existing charge shortage and possibly misunderstand that the watch has been broken if only the warning display for charging by hands 9 is provided. Further, if only the warning display by a digital display is provided and the displayed warning mark for charging 10 is too small, the user may fail to visually notice the warning mark 10 though a warning display is provided.

Therefore, a purpose of the present invention is to provide a combination electronic watch constructed by depositing a solar cell and a digital block one onto the other in the vertical direction toward the display surface of the watch, forming a window in a part of the solar member, and allowing the digital display of the liquid crystal unit to be transparently displayed through the window, so that the location of the digital block can be freely designed and the space efficiency of power generating surface 12*a* is improved over conventional watches.

Another purpose of the invention is to provide a combination electronic watch which makes it possible for the user to readily recognize a currently occurring charge shortage by simultaneously providing warning displays for charging both by hands and by a digital display so as to emphasize such a charge shortage status.

DISCLOSURE OF THE INVENTION

The present invention provides a combination electronic watch comprising analog display means for displaying information related to the watch such as time in an analog manner, digital display means for displaying information related to the watch such as time in a digital manner, and a solar member for performing solar power generation by absorbing light including solar light, wherein said solar member is positioned closer to the display surface side of the watch than the digital display means is located and a window is formed at the location in the solar member corresponding to the digital display means so that the contents displayed on the digital display means can be recognized through the window.

Therefore, it has become possible for the digital display unit to be freely designed by changing the shape of the window in the solar member without altering the shapes and locations of the constituting components. Consequently, low-priced and attractive watches can be serialized in a relatively easy manner. Further, since the space efficiency of the power generating surface of the solar member is improved over the conventional watch modules, a higher capacity of solar power generation may be provided.

Moreover, the present invention provides a combination electronic watch which further comprises means for storing power generated by said solar member, means which is operative in response to the power from the storing means for controlling the analog display means and digital display means and for detecting the voltage across the storing means which generates a warning signal for charging both to analog display means and to digital display means when the detected voltage value is lower than a predetermined value, thereby simultaneously providing warnings on both the analog display means and digital display means.

Accordingly, the present invention have the user recognize warnings of charge shortage as emphasized.

BEST MODES FOR EMBODYING THE INVENTION

Figure 1:
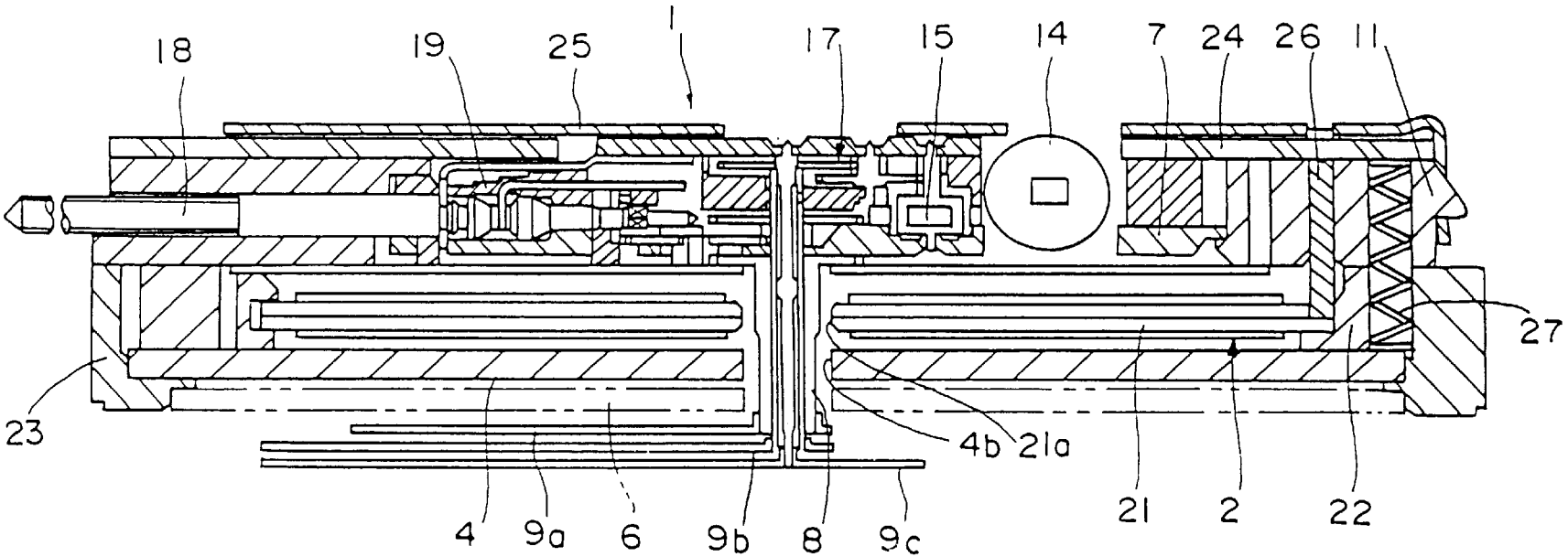
FIG. 1 shows a cross sectional view (along line 1—1 in FIG. 2) of a combination electronic watch which is an embodiment of the present invention.

An embodiment of the combination electronic watch will now be described by referring to FIG. 1 to FIG. 4.

The entire arrangement of the components constituting the combination electronic watch will first be described.

Analog block 1, which has the same construction as a conventional analog block, comprises main plate 7 forming a base substrate, step motor 14 which converts electric power into mechanical work, hand display ring series 17 which transfer rotating torque to hands 9 from rotor 15 constituting said step motor 14, and external operation switching mechanism 19 which includes winding stem 18 and serves to modify the hands. This analog block 1 is positioned substantially at the center of the watch module and contained within and held by support 11 formed of engineering plastic material so that rotating axes 8 of hands 9 are substantially located at the center of the watch display surface.

Digital block 2 comprises said support 11, liquid crystal cell 21 positioned in the cross-sectional direction toward dial 6 relative to the analog block 1, liquid crystal support frame 22 made of engineering plastic material which functions to contain and hold said liquid crystal cell 21.

Solar member 4 is positioned in the cross-sectional direction toward dial 6 relative to the liquid crystal unit 21. This solar member 4 is contained within and held by support frame 23 made of engineering plastic material.

Circuit substrate 24 is securely hooked onto the other side (opposite of the watch display side) of analog block 1 for digital block 2 by circuit supporting board 25. The end (fringe) of circuit substrate 24 is fixedly engaged by a hook (not shown in the figure) which is integrally formed onto supporting frame 23. Thus, circuit substrate 24 is secured to supporting frame 23 as surrounding support 11. Liquid crystal unit 21 and solar member 4 are electrically connected to circuit substrate 24 by using the liquid crystal connecting rubber 26 and solar connecting spring 27, respectively.

Figure 2:
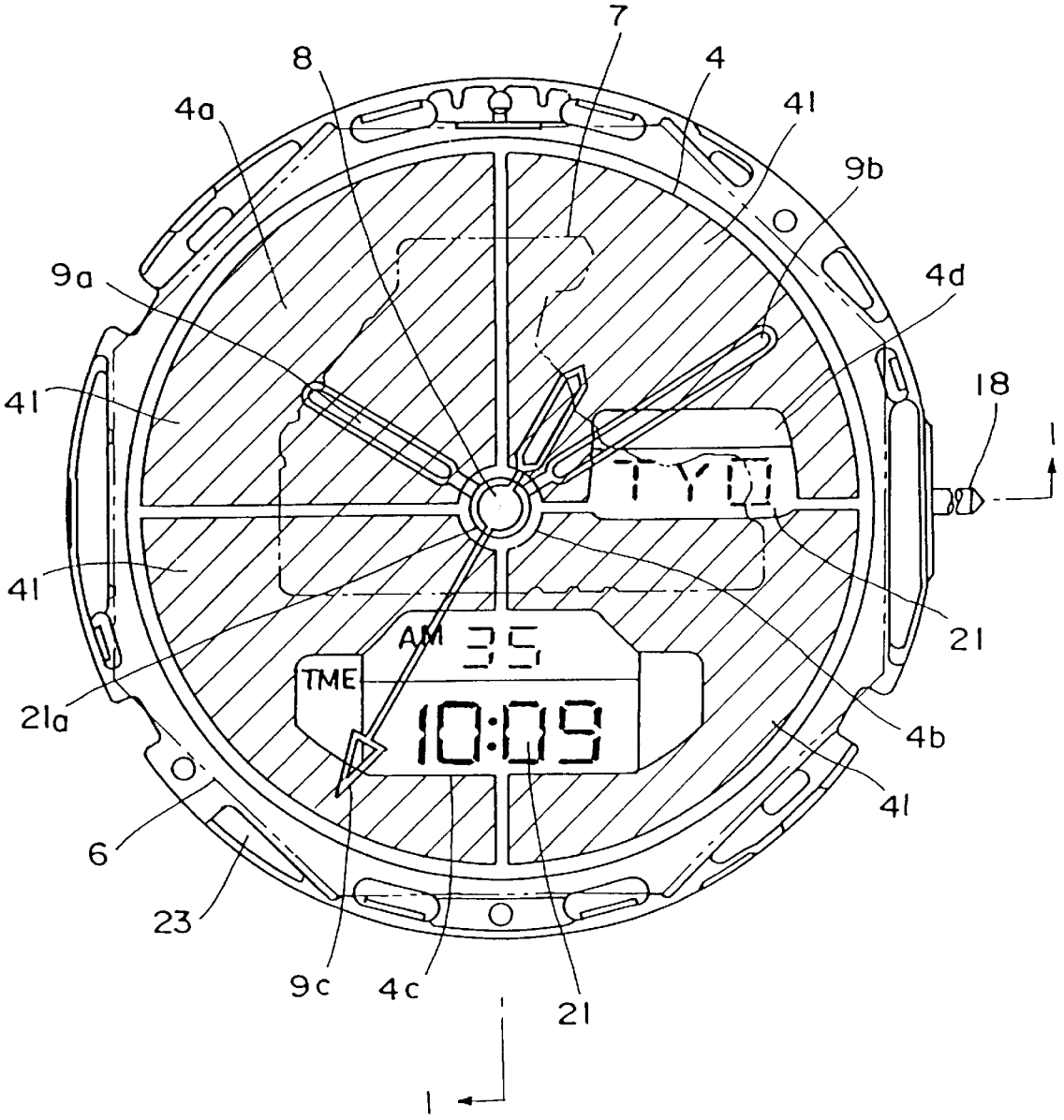
FIG. 2 shows a plan view of the same combination electronic watch with its dial removed.

Further, in this combination Electronic watch, a storage battery and a controlling IC are included though these are not shown in FIG. 1 and FIG. 2.

Dial 6 is made of transparent plastic material so as to allow the digital display formed by liquid crystal unit 21 to be seen from the front side of the watch and not to interfere with the absorption of light including the sun.

Therefore, the combination electronic watch in accordance with the invention is constructed in such a manner that liquid crystal unit 21, solar member 4 and dial 6 are deposited one after another onto analog block 1 in this order.

Next, by referring to FIG. 2, the horizontal arrangement of the components in the watch module will now be described.

Rotating axes 8 of hands 9 are positioned at the center of the watch and power generating surface 4*a* of solar member 4 is positioned so as to occupy almost all the display surface of the watch. Solar member 4 has opening 4*b* which allows rotating axes 8 of hands 9 to pass through. Also, power generating surface 4*a* of solar member 4 which has a glass substrate as a base has windows 4*c* and 4*d* formed therein by not depositing any optic power generating elements. By arranging them in such manners, the digital display of liquid crystal unit 21 which is positioned beneath windows 4*c* and 4*d* can be seen therethrough.

Liquid crystal unit 21 is, which is slightly smaller than solar member 4, dimensioned to be deposited substantially across the entire display surface of the watch. Therefore, liquid crystal unit 21 has an opening 21*a* formed on itself for rotating axes 8 of hands 9 to pass through.

Due to the above-mentioned structure, when combination watches having a solar power generation unit are serialized by altering the display surface design of the watch, the digital display unit can be freely designed,without altering the shapes and locations of the constituting components such as solar cell 12, liquid crystal cell 11 by changing the shapes of windows 4*c* and 4*d*. In consequence, low-priced and attractive watches can be serialized in a relatively easy manner.

Further, since the space efficiency of power generating surface 4*a* is improved over the conventional watch modules by being able to deposit solar member 4 in a larger area, watches with higher capacity of optic power generation may be provided despite the formation of the windows.

Hereafter, an explanation of solar member will be given.

In the electronic watch of the present invention, solar member 4 is divided into four portions and these four divided solar members 4 are connected in series. In this case, though it is preferable to maximize the supply current that the divided four solar members are similarly dimensioned to substantially have the same area, the area of each of the divided portions necessarily become different from one another if the sizes, shapes, and locations of windows 4*c* and 4*d* are freely determined in designing them.

However, though solar member 4 is unequally divided as far as it can provide power sufficient to guarantee the driving of the watch, such an inequality does not adversely affect the performance and functions of the watch.

In actual situations, since the area of solar cell member 4 deposited on the electric watch is 440 $mm^2$, one of the divided-into-four solar member 41 is 110 $mm^2$. However, solar cell member 41 on which windows 4*c* and 4*d* are formed has the area less than 110 $mm^2$.

The amount of current required to drive the electric watch of the invention for one day is 24 $\mu$A. In order to obtain 24 $\mu$A by being exposed to 500 lux light for three hours, one solar cell member 41 of the four divided solar cell members must be at least 80 $mm^2$ large. In other words, since windows 4*c* and 4*d* can be as large as 30 $mm^2$ respectively, the sizes, shapes and locations of windows 4*c* and 4*d* are not restricted. Even though four solar cell members 41 have been unequally divided, no problems exist at all as long as each has the area of at least 80 $mm^2$ in this case.

If a highly transparent material is used as dial 6, diving lines of solar members 4 may transparently be seen. In such a case, the locations of the dividing lines may not arbitrarily selected due to a restriction from a design viewpoint and solar cell 4 can not be equally divided into four. There are no problems in such a case, however, if each divided member has the area of at least 80 $mm^2$.

Although the solar cell of the above-mentioned embodiment is composed of a glass substrate, a stainless steel substrate may also be employed, in which case, windows 4*c* and 4*d* may also be formed by making openings in solar member 4.

In the combination electronic watch in accordance with the invention, window 4*c* displays information such as time, calendar, and mode whereas window 4*d* displays information such as name of the city and warning for charging.

Figure 3:
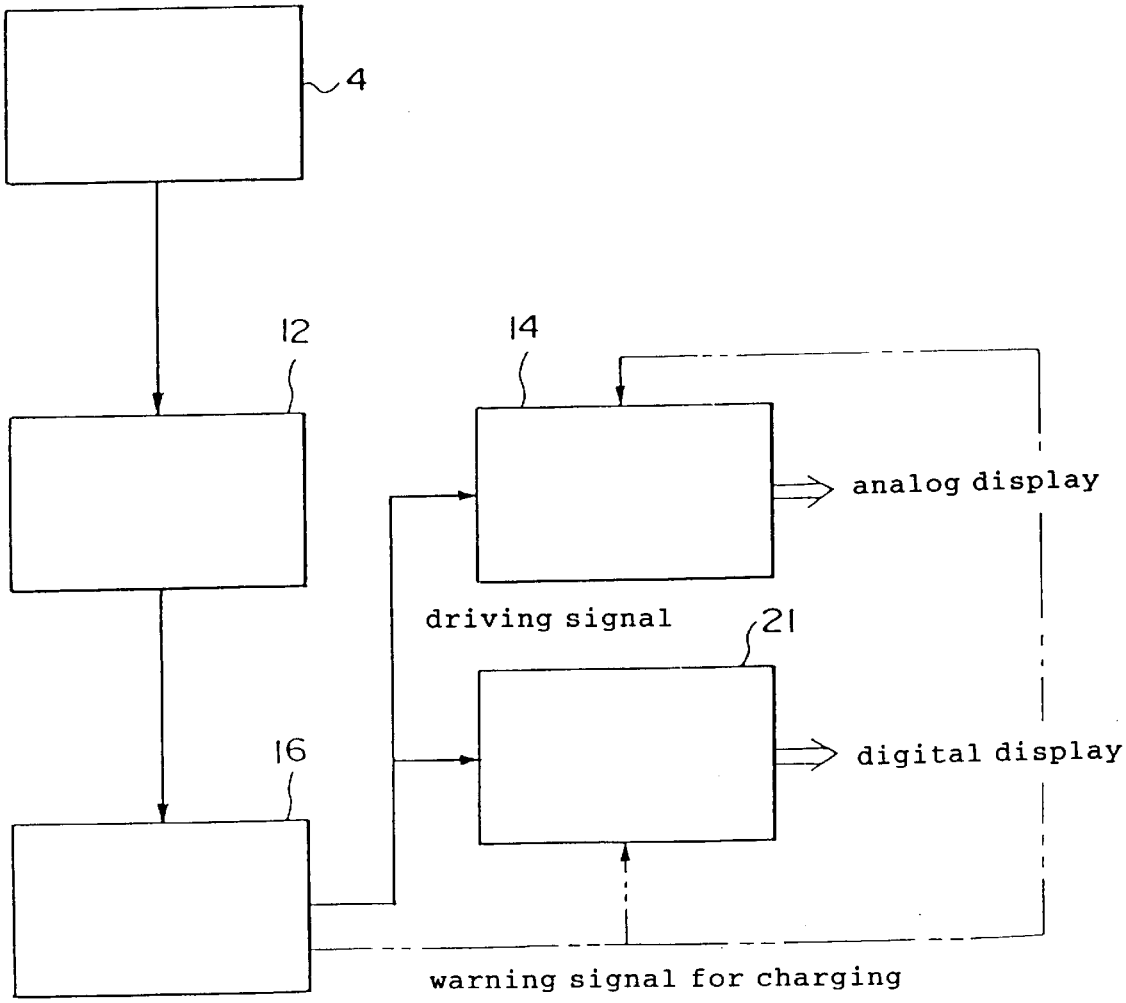
FIG. 3 shows the electric schematic diagram of the same combination electronic watch.
Figure 4:
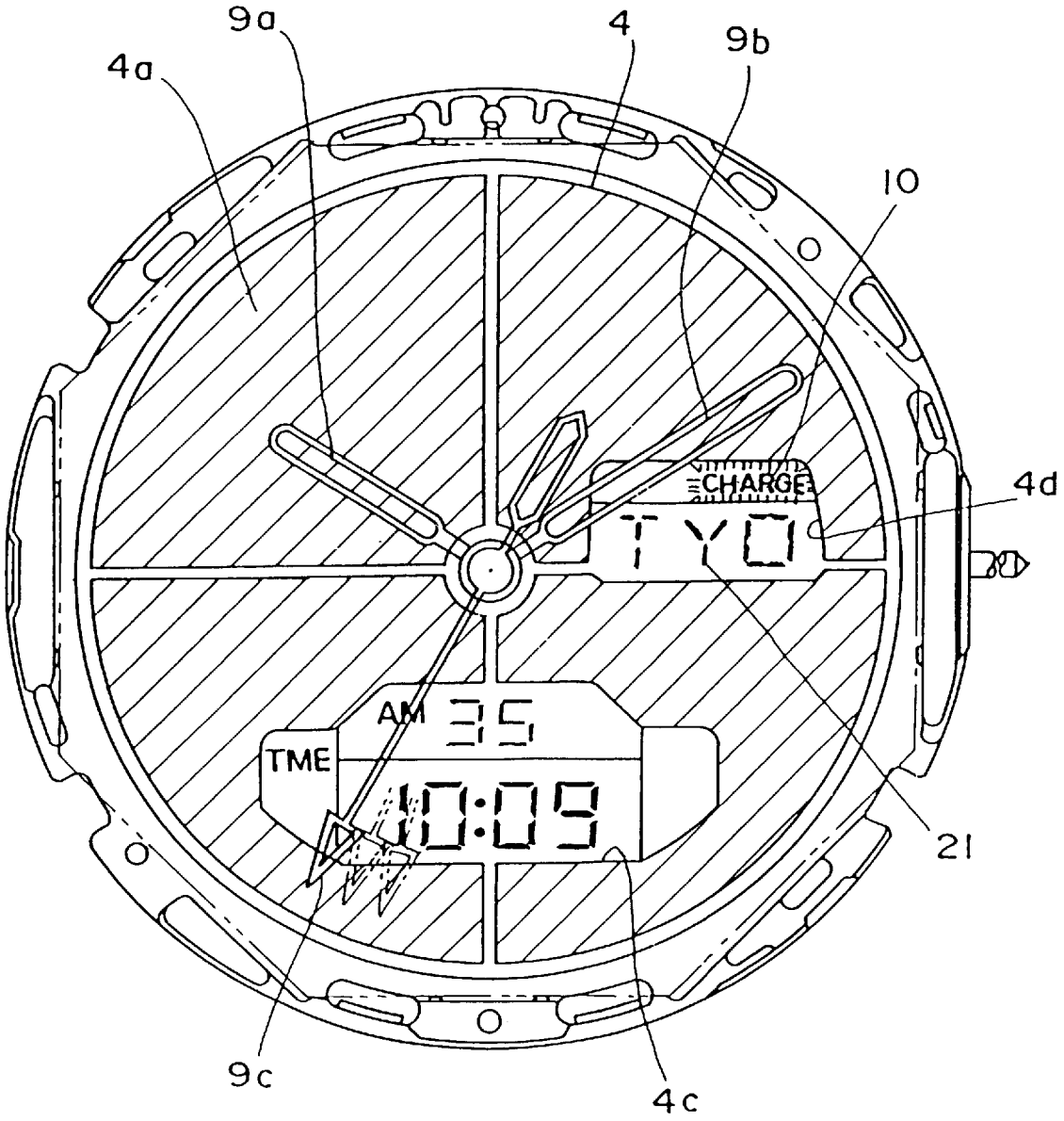
FIG. 4 shows a plan view of the same combination electronic watch which is displaying a warning for charging.
Figure 5:
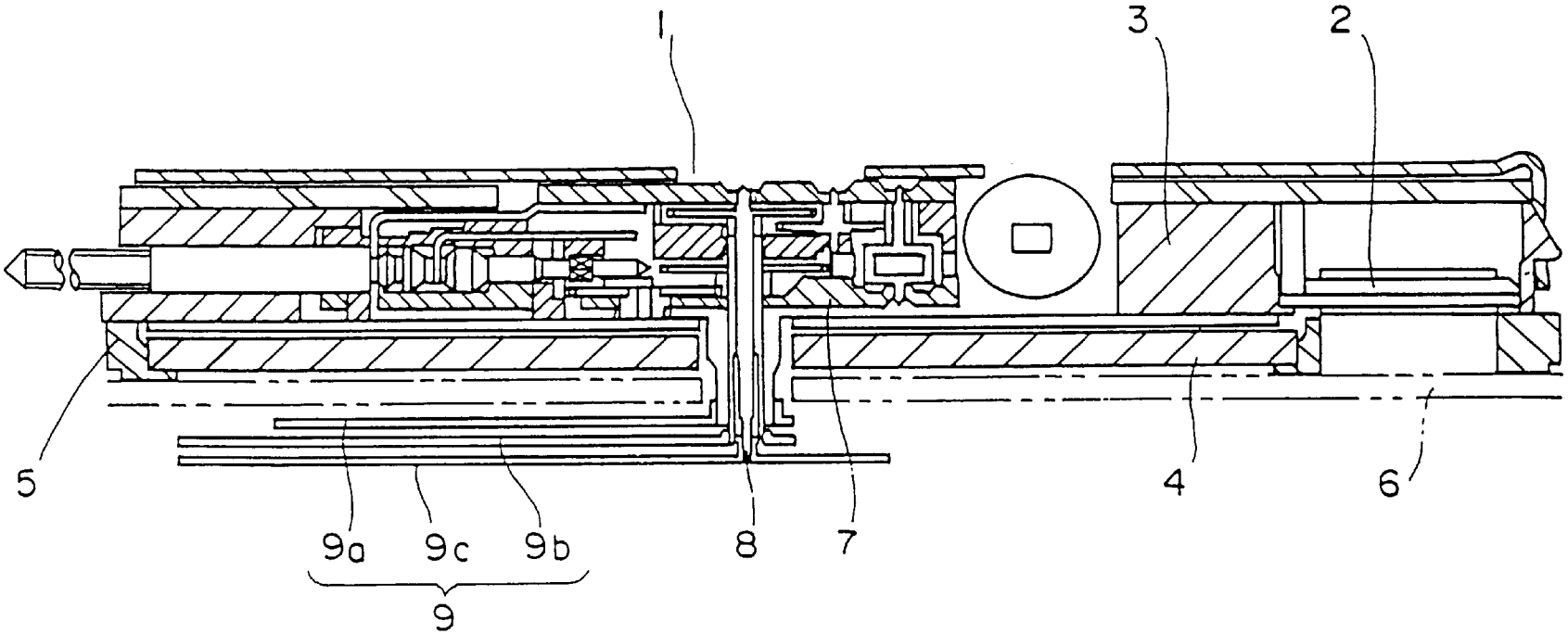
FIG. 5 shows a cross sectional view (along line 5—5 in FIG. 6) of a prior art combination electronic watch.
Figure 6:
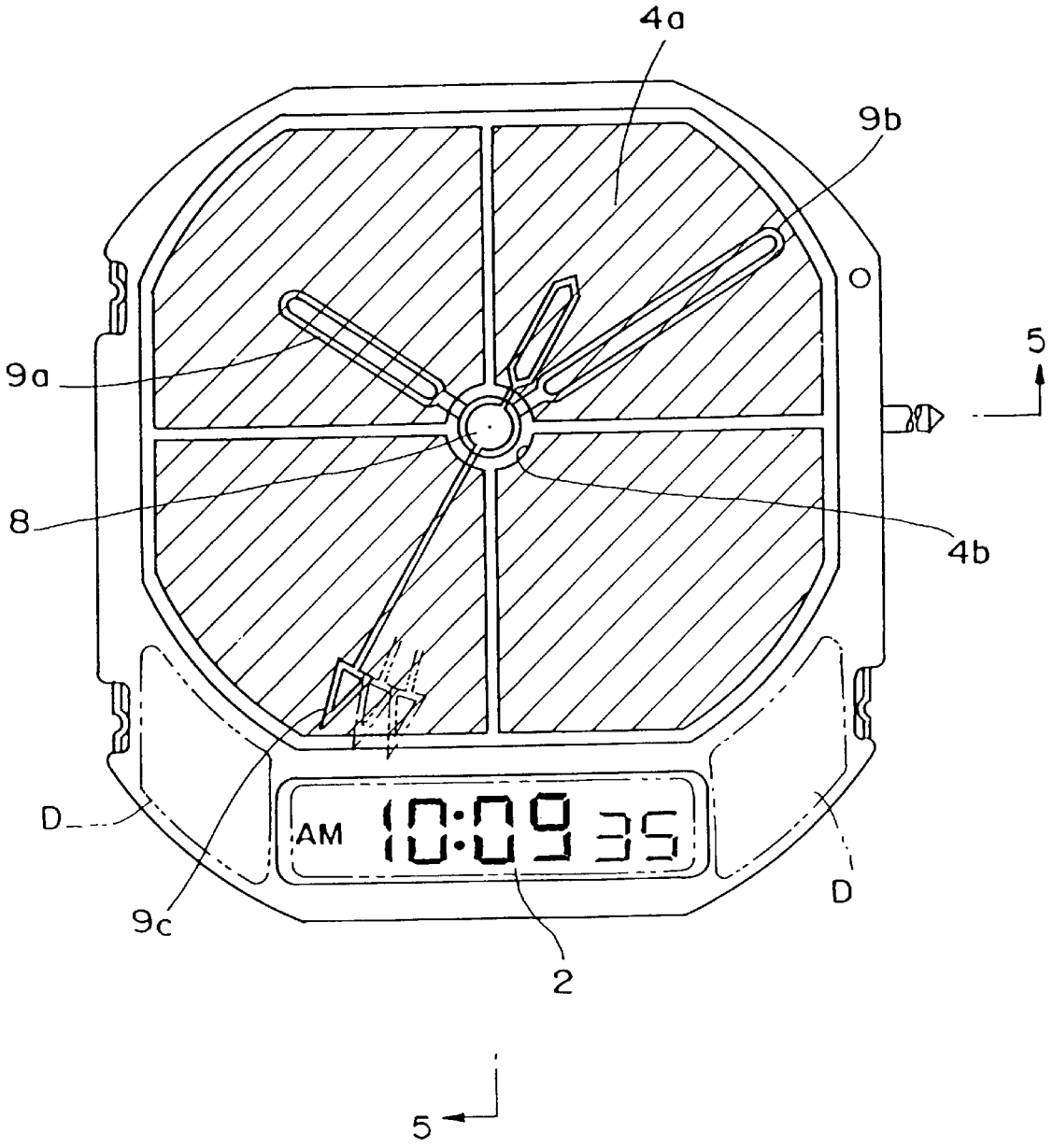
FIG. 6. shows a plan view of the same prior art combination electronic watch with its dial removed.
Figure 7:
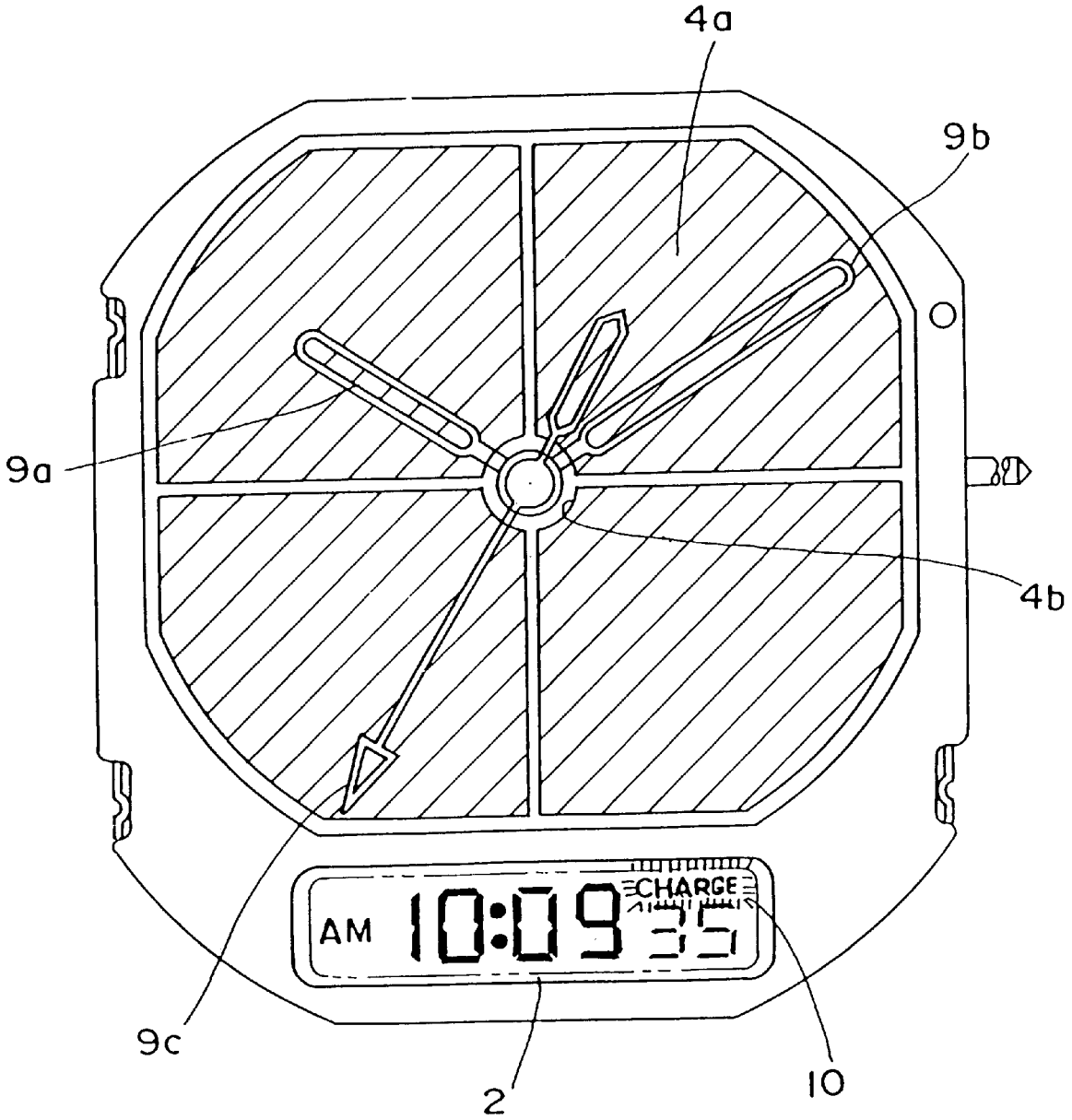
FIG. 7. shows a plan view of the same prior art combination electronic watch which is only digitally displaying a warning for charging.

By referring to FIG. 3 and FIG. 4, an explanation about the warning for charging will now be provided.

FIG. 3 is a block diagram which shows the circuit arrangement of the combination electronic watch.

Power generated by solar member 4 is temporarily stored in storage battery 12. This storage battery 12 constantly supplies power to integrated circuit (IC) 16 which controls all the functions of the watch. This IC 16 transmits driving signals for driving the watch to step motor 14 of analog block 1 and liquid crystal cell 21 of digital block 2. Thus, information including time will be displayed by hands 9 consisted of hour hand 9*a*, minute hand 9*b*, and second hand 9*c* and by liquid crystal unit 21 in both analog and digital manners.

Also, this IC 16 constantly detects the voltage across storage battery 12 and transmits a warning signal for charging to both step motor 14 and liquid crystal unit 21 when it determines the stored amount has been decreased by detecting that the voltage is lower than a predetermined value.

Step motor 14, when it receives the warning signal for charging, has second hand 9*c* move once every two seconds. Also liquid crystal unit 21, when it receives the warning signal for charging, makes warning mark for charging 10 within liquid crystal unit 21 corresponding to window 4*d* to be blinkingly displayed. A warning for charging may thus be simultaneously displayed both by the analog display of hands 9 and by the digital display on liquid crystal unit 21. Therefore, when the combination watch is short of charge, the user can readily recognize the charge shortage.

The present invention is not restricted to the above described embodiments.

For example, other opto-electronic elements other than LED may be used as the digital display. The size of the opto-electronic element do not have to be dimensioned similarly to the display surface of the watch and the element may be three fourth as large as the display surface or may have a different shape as long as such a change or modification does not interfere the implementation of the invention.

INDUSTRIAL APPLICABILITY OF THE INVENTION

The present invention may be applied to a variety of small electronic devices equipped with a combination electronic watch which has a time display means composed of both an analog display means and digital display means and a solar power generation function.

What is claimed is:

1. A combination electronic watch comprising, analog display means for displaying information relative to a watch in an analog manner, said analog display means having a dial, digital display means for displaying information relative to the watch in a digital manner, said digital display means having a size substantially same as that of the dial of the analog display means and a display portion therein, and a solar member for generating optical power by absorbing light including solar light, said solar member having a size substantially same as that of the dial similar to the digital display means and a window with a size to allow the solar member excluding the window to generate optical power sufficient to operate the watch, said solar member being disposed over the digital display means to overlap thereto at a display side of the watch so that the window is located on the display portion of the digital display means.

2. The combination electronic watch according to claim 1 wherein an analog block is positioned beneath the digital display means.

3. The combination electronic watch according to claim 1 wherein the solar member is constituted by depositing optic power generating elements on a glass substrate and the window is formed by failure to deposit such optic power generating elements thereon.

4. The combination electronic watch according to claim 1 further comprising, means for storing power generated by said solar member, and means which is operative in response to the power form the storing means for controlling the analog display means and digital display means, and for detecting the voltage across the storing means which generates a warning signal for charging to both analog display means and digital display means when the detected voltage value is lower than a predetermined value, thereby providing warnings on both the analog display means and digital display means.

5. The combination electronic watch according to claim 2, wherein said analog display means includes rotating axes for hands, said digital display means and solar member having holes for allowing the rotating axes to pass therethrough.

6. The combination electronic watch according to claim 4, wherein said digital display means includes a digital display portion and a warning portion for warning separately from the digital display portion by digital display.

7. The combination electronic watch according to claim 1, wherein said display portion is a part of the digital display means and is disposed under the window.

* * * * *